US009151282B2

(12) United States Patent
Rulli et al.

(10) Patent No.: US 9,151,282 B2
(45) Date of Patent: Oct. 6, 2015

(54) HUMAN POWERED IRRIGATION DIAPHRAGM PUMP

(75) Inventors: Samuel R. Rulli, Gloucester, MA (US); Robert W. King, South Hamilton, MA (US); Keith Teichmann, Newton Centre, MA (US)

(73) Assignee: FLOW CONTROL LLC., Beverly, MA (US)

( * ) Notice: Subject to any disclaimer, the term of this patent is extended or adjusted under 35 U.S.C. 154(b) by 257 days.

(21) Appl. No.: 13/567,598

(22) Filed: Aug. 6, 2012

(65) Prior Publication Data

US 2013/0032232 A1 Feb. 7, 2013

Related U.S. Application Data

(60) Provisional application No. 61/515,375, filed on Aug. 5, 2011.

(51) Int. Cl.
*F04B 9/14* (2006.01)
*F04B 43/02* (2006.01)

(52) U.S. Cl.
CPC ..... *F04B 9/14* (2013.01); *F04B 43/026* (2013.01); *Y10S 417/903* (2013.01); *Y10T 137/86099* (2015.04)

(58) Field of Classification Search
CPC . F04B 43/026; F04B 9/14; Y10T 137/86099; Y10S 417/903
USPC ..... 417/903, 533, 534, 539, 544; 482/53, 482/112, 113
See application file for complete search history.

(56) References Cited

U.S. PATENT DOCUMENTS

| | | | | | |
|---|---|---|---|---|---|
| 439,992 | A | * | 11/1890 | Anderson | 74/104 |
| 1,212,923 | A | * | 1/1917 | Faucher | 92/37 |
| 1,974,964 | A | * | 9/1934 | Lyons et al. | 74/105 |
| 2,228,714 | A | | 1/1941 | Wiltse | |
| 2,473,986 | A | | 6/1949 | Booth | |
| 2,844,102 | A | | 7/1958 | Oishei | |

(Continued)

FOREIGN PATENT DOCUMENTS

| | | |
|---|---|---|
| CN | 2283031 | 6/1998 |
| EP | 1995459 | 11/2008 |
| JP | 60050286 | 3/1985 |

OTHER PUBLICATIONS

Pressure Treadle Pump—Span Pumps Pvt Ltd, http://www.youtube.com/watch?v=zsVhQSdVHRg, uploaded on Nov. 12, 2010.*

(Continued)

*Primary Examiner* — Devon Kramer
*Assistant Examiner* — Nathan Zollinger

(57) ABSTRACT

A pump system includes a pump unit an assembly frame that receives first and second pumps. A first and second pedal respectively couples to a first and second pump actuating portion. A rocker arrangement has a rocker that pivotally couples the first and second pedals, so a pushing movement of the first pedal in one direction causes a pulling movement of the second pedal in an opposite direction, and vice versa. The first and second pedals respond to a pushing force, respectively move the first and second pump actuating portions for pumping a fluid from the first and second pumps, and correspondingly move the first and second pump actuating portions for drawing the fluid to be pumped into the first and second pumps.

9 Claims, 8 Drawing Sheets

Stream/pond Pump Unit 12

Shallow Well Frame 30 with Pump Unit 12

(56) References Cited

U.S. PATENT DOCUMENTS

| | | | |
|---|---|---|---|
| 2,864,116 | A | 12/1958 | Rohr |
| 3,301,190 | A | 1/1967 | Gondek |
| 4,124,334 | A | 11/1978 | Mazzetti |
| 4,162,549 | A | 7/1979 | Charles et al. |
| 4,319,570 | A | 3/1982 | Grane |
| 4,526,520 | A | 7/1985 | Henderson |
| RE32,144 | E | 5/1986 | Keefer |
| 4,862,533 | A | 9/1989 | Adams, III |
| 5,201,638 | A | 4/1993 | Bieri |
| 5,649,809 | A | 7/1997 | Stapelfeldt |
| 5,792,029 | A | 8/1998 | Gordon |
| 7,396,218 | B2 | 7/2008 | Hyde et al. |
| 8,770,954 | B2 * | 7/2014 | Spybey et al. ..... 417/544 |
| 2008/0267800 | A1 | 10/2008 | McNeil |
| 2008/0315590 | A1 | 12/2008 | Reyes-Florido |

OTHER PUBLICATIONS

Orr et al., "The Treadle Pump Manual Irrigation for Small Farmers in 1-14 Bangladesh." Rangpur Dinajpur Rural Service, Pioneer Printing Press Ltd. Dhaka, 1991, p. 11,85.

English Language Abstract JP60050286 (1 page).

English Language Abstract CN2283031 (1 page).

* cited by examiner

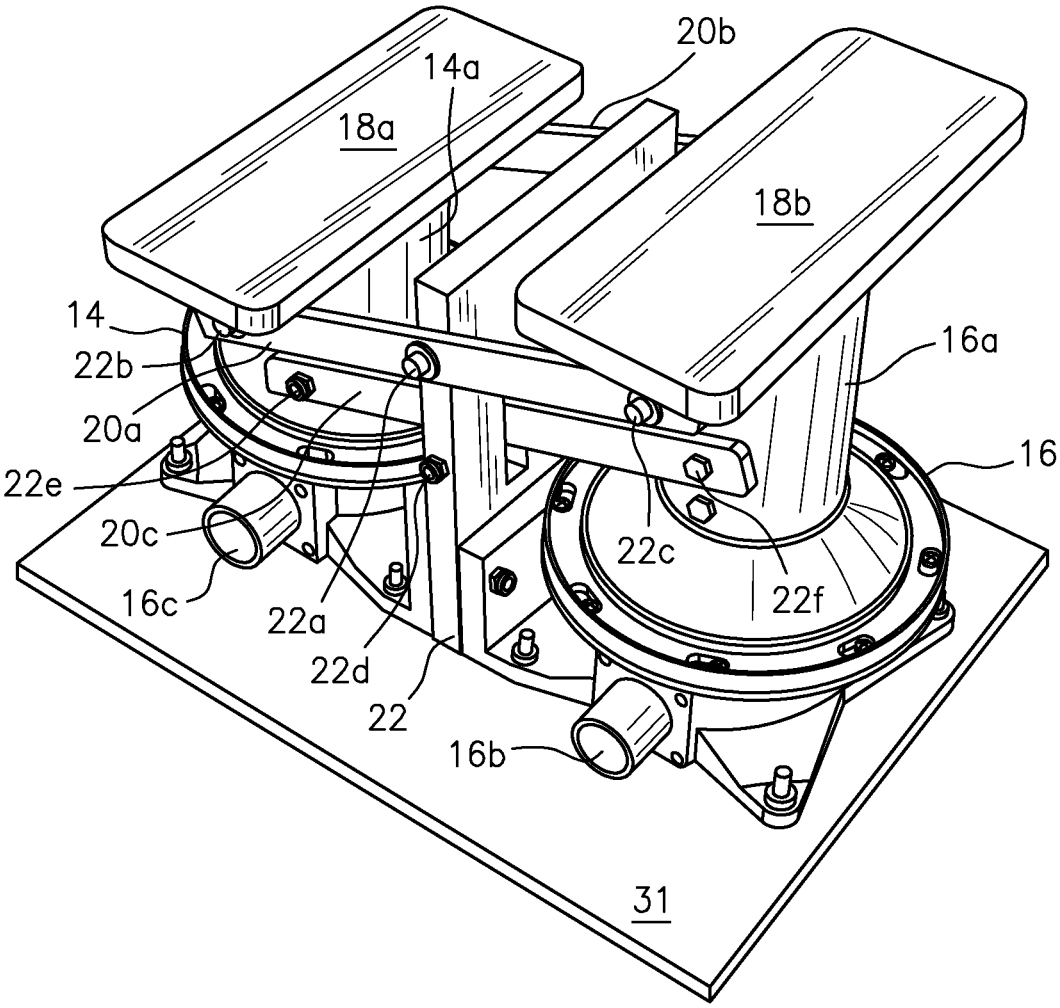
*FIG. 2a*: Stream/pond Pump Unit 12

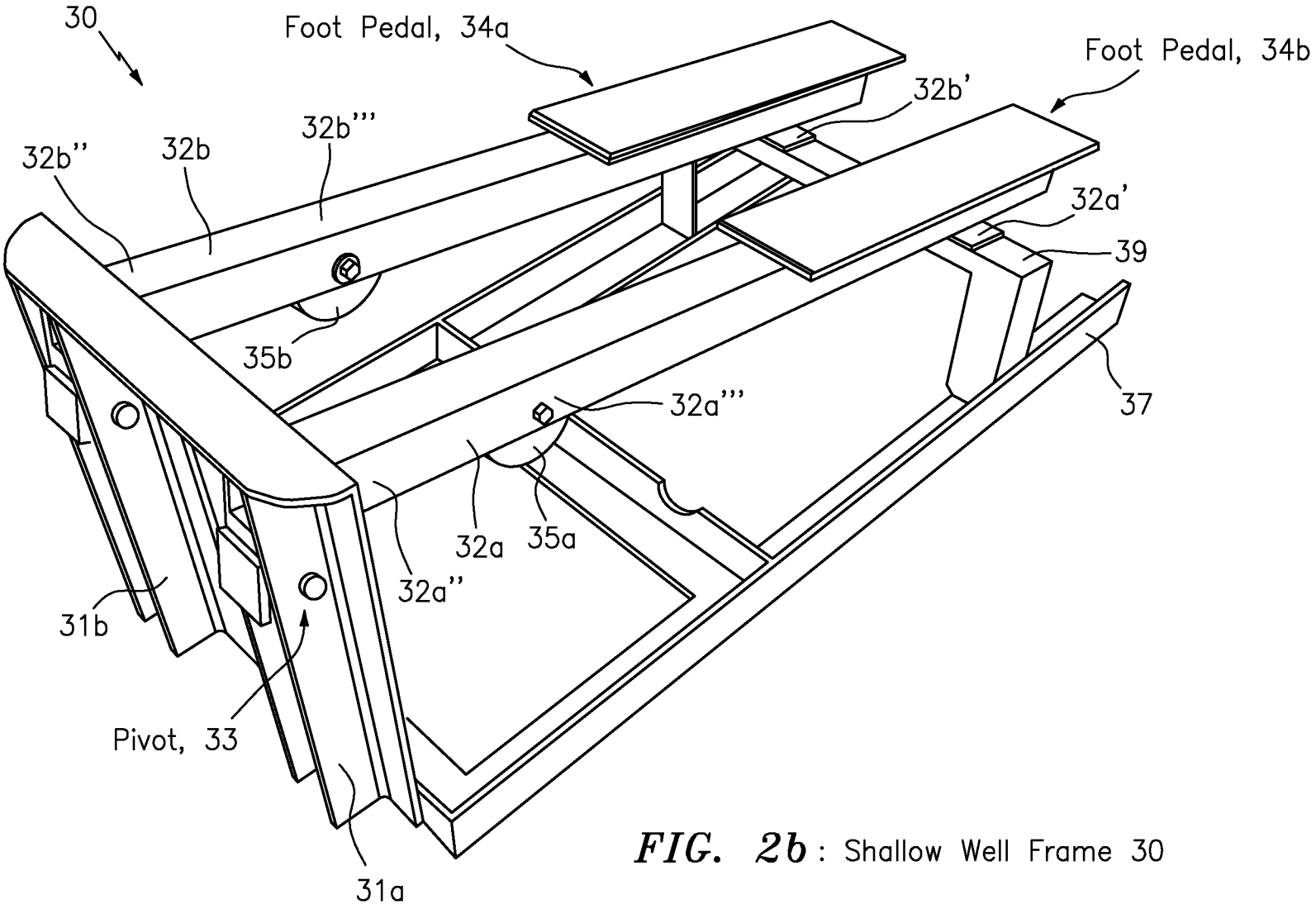
*FIG. 2b*: Shallow Well Frame 30

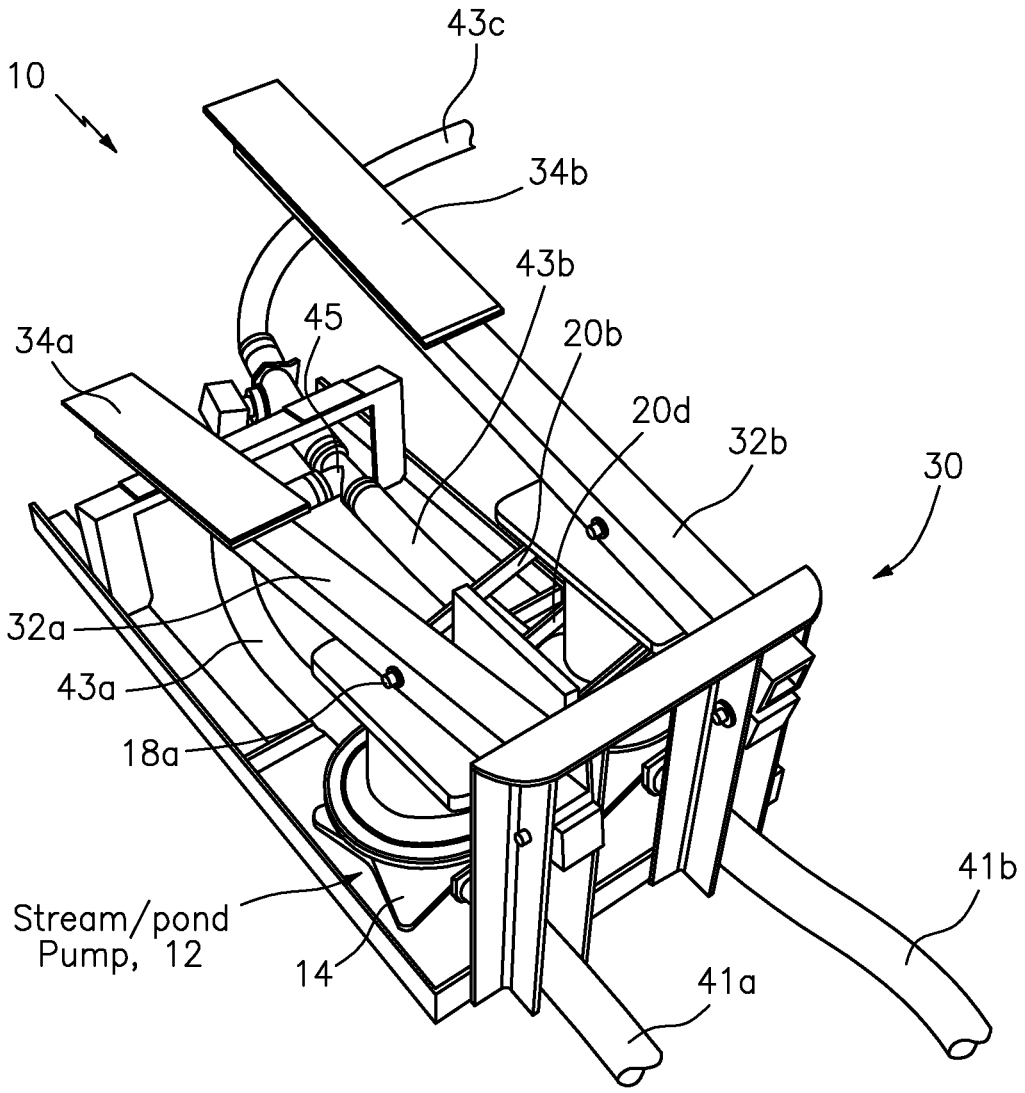
*FIG. 2c* : Shallow Well Frame 30 with Pump Unit 12

HUMAN POWERED IRRIGATION DIAPHRAGM PUMP

CROSS REFERENCE TO RELATED APPLICATIONS

This application claims benefit to patent application Ser. No. 61/515,375, filed 5 Aug. 2011, entitled Human Powered Irrigation Diaphragm Modular Pump, which is hereby incorporated by reference in its entirety.

BACKGROUND OF THE INVENTION

1. Field of Invention

The present invention relates to a pump or pump system; and more particularly a pump or pump system configured to be powered by a human.

2. Brief Description of Related Art

There is a need to irrigate vegetation in remote locations by using human/manual power. These remote locations do not have access to electricity or liquid fuel, therefore the need of human powered devices is extremely important, and arguably a must. An inexpensive manually driven pump is required to lift water from streams, ponds or shallow wells to crops, so they can grow in the non-rainy seasons.

By way of example, FIG. 1 shows a known foot powered pump. Current pumps known on the market today like that shown in FIG. 1 typically have to be carried to a location in order to be used.

SUMMARY OF THE INVENTION

According to some embodiments, the present invention provides, or takes the form of, a new and unique apparatus, including a pump system, that includes a first pump configured with a first pump actuating portion; a second pump configured with a second pump actuating portion; and an assembly frame configured to receive the first pump and the second pump. The assembly frame includes a first pedal coupled to the first pump actuating portion, and a second pedal coupled to the second pump actuating portion. The assembly frame also includes a rocker arrangement with at least one rocker configured to pivotally couple the first pedal to the second pedal, so that a pushing movement of the first pedal in one direction causes a pulling movement of the second pedal in an opposite direction, and so that a corresponding pushing movement of the second pedal in the one direction causes a corresponding pulling movement of the first pedal in the opposite direction. In operation, the first pedal is configured to respond to a pushing force, move the first pump actuating portion for pumping a fluid from the first pump, and correspondingly move the second pump actuating portion for drawing the fluid to be pumped into the second pump; and the second pedal is configured to respond to a corresponding pushing force, move the second pump actuating portion for pumping the fluid from the second pump, and correspondingly move the first pump actuating portion for drawing the fluid to be pumped into the first pump.

According to some embodiments, the present invention may include one or more of the following features:

The first pump and the second pump may be, or take the form of, diaphragm pumps. The first pump actuating portion may include, or take the form of, a first piston portion, e.g., that is coupled to a first diaphragm portion of a first diaphragm pump. The second pump actuating portion may include, or take the form of, a second piston portion, e.g., that is coupled to a second diaphragm portion of a second diaphragm pump.

The rocker arrangement may include a center assembly frame member arranged between the first pump and the second pump; and the at least one rocker may be configured to attach pivotally to the center assembly frame member and couple to the first pump actuating portion and the second pump actuating portion. The at least one rocker may include a first rocker configured to attach pivotally to one end of the center assembly frame member and couple to the first pump actuating portion and the second pump actuating portion; and also include a second rocker configured to attach pivotally to another end of the center assembly frame member and also couple to the first pump actuating portion and the second pump actuating portion. The at least one rocker may include an upper rocker configured to attach pivotally to an upper portion of the center assembly frame member and couple to the first pump actuating portion and the second pump actuating portion; and also include a lower rocker configured to attach pivotally to a lower portion of the center assembly frame member and also couple to the first pump actuating portion and the second pump actuating portion. The center assembly frame member may include an internal wall portion; and the lower rocker may be configured to attach pivotally to the internal wall portion.

The first pedal may be coupled directly to the first pump actuating portion, e.g., the first piston portion of the first pump; and the second pedal may be coupled directly to the second pump actuating portion, e.g., the second piston portion of the second pump.

The assembly frame may further include a frame unit having a first elongated assembly frame member with one end portion configured with a first extended pedal, and with another end configured to couple pivotally to one part of the assembly frame; and also having a second elongated assembly frame member with one corresponding end portion configured with a second extended pedal, and with another corresponding end configured to couple pivotally to another part of the assembly frame.

The first elongated assembly frame member may include an intermediate portion configured with a first wheel rotationally coupled thereto for rolling on the first pedal; and the second elongated assembly frame member may include a corresponding intermediate portion configured with a second wheel rotationally coupled thereto for rolling on the second pedal.

Alternatively, the first elongated assembly frame member may include an intermediate portion configured to couple to the first pump actuating portion and a first end of the at least one rocker, and the second elongated assembly frame member may include a corresponding intermediate portion configured to couple to the second pump actuating portion and a second end of the at least one rocker. In this case, the intermediate portion may also be configured to couple to the first pedal to the first pump actuating portion, and the corresponding intermediate portion may also be configured to couple to the second pedal to the second pump actuating portion.

The assembly frame may also include a T-shaped handle configured to extend from the center assembly frame member and be held by a user when operating the pump system.

The assembly frame may also include a wheel configured on a part of the assembly frame for tilting and rolling the pump system.

Some difference between this known manual driven foot powered water pump and the pump system according to the present invention include the following: The known manual driven foot powered water pump differs from the existing units by first using two horizontally mounted diaphragm pumps and second using a different rocking device so as one diaphragm pump is pushed down the other is pulled up with the same foot. The third difference is that the pump system according to the present invention is a modular design so that it can be used in two different applications stream/pond and shallow well. The modular design also provides the opportunity to buy the small stream/pond pump at a low cost and later if needed buy the frame to power the pump for shallow wells. A fourth difference is that the pump system according to the present invention may be configured to be portable by incorporating a wheel onto the pump structure, so that a person can wheel the pump to any location it is needed instead of carrying it like current pumps on the market today.

BRIEF DESCRIPTION OF THE DRAWING

The drawing, which is not necessarily drawn to scale, includes the following Figures:

FIG. 2 shows apparatus, including a pump system, according to some embodiments of the present invention, including FIG. 2*a* that is a perspective view of a pump unit that may form part of the pump system; FIG. 2*b* that is a perspective view a frame unit that may form part of the pump system; and FIG. 2*c* that is a perspective view of the pump system having the pump unit shown in FIG. 2*a* and the frame unit shown in FIG. 2*b*.

DETAILED DESCRIPTION OF THE INVENTION

Brief Summary

Figure 1:
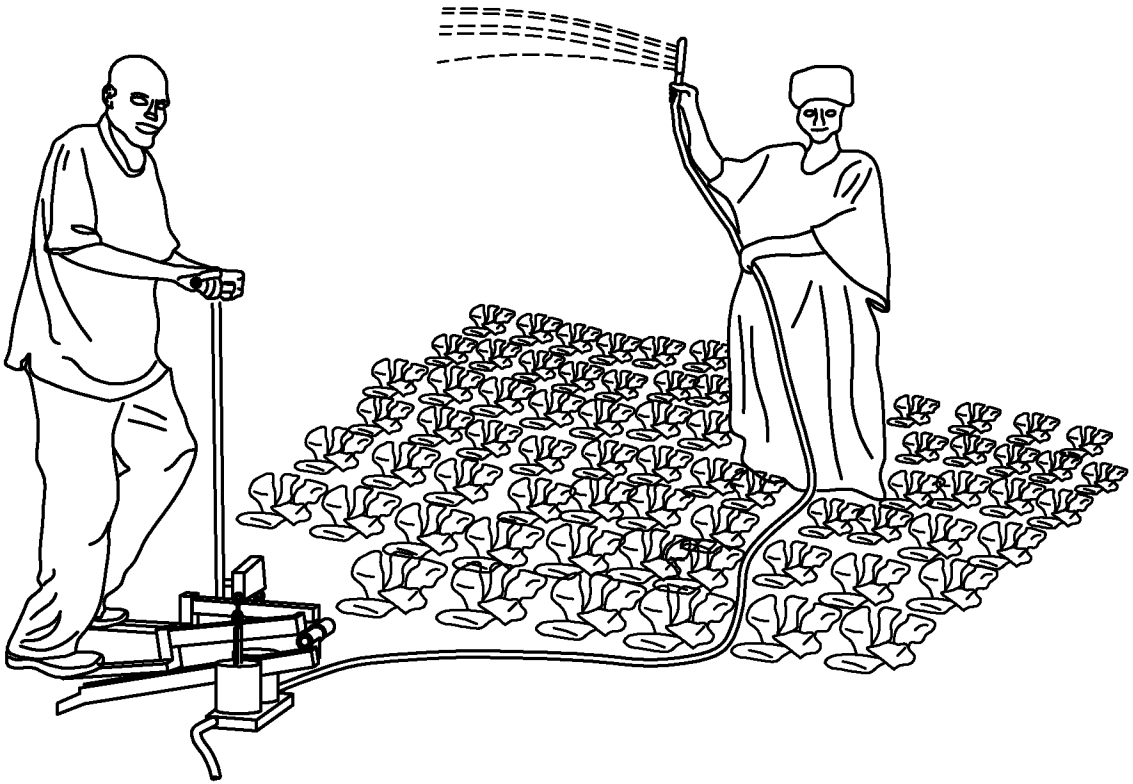
FIG. 1 (PRIOR ART)
FIG. 1 is a photograph of a irrigation pump that is known in the art.

FIGS. 2-3 show apparatus, including a pump system, generally indicated as 10 (FIG. 2) and 100 (FIG. 3) according to some embodiments of the present invention.

According to embodiments shown in relation to FIG. 2, the pump system 10 may include two modular units: a pump unit 12 driven with two large diaphragm pumps 14, 16 (see FIG. 2*a*, showing an example of a stream/pond pump); and a frame unit generally indicated as 30 (see FIG. 2*b* showing a shallow well frame) that the pump unit 12 fits into providing a mechanical advantage, e.g., as shown in FIG. 2*c*. In the stream/pond pump unit 12, the two diaphragm pumps 14, 16 may be configured to be fully self-priming at all envisioned operational depths. The stream/pond pump unit 12 can be used without the frame unit 30 (FIGS. 2*b*-2*c*) by standing on top of two foot pedals 18*a*, 18*b* directly above the diaphragm pumps 14, 16 and then shifting one's weight from one leg to the next. In FIG. 2*a*, at least one rocker in the form of bars 20*a*, 20*b* are connected to the foot pedals 18*a*, 18*b*, as well as a center assembly frame member 22 in order to provide the capability to push down on one pedal 18*a* or 18*b* and pull up on the other pedal 18*a* or 18*b* with one foot. The pump unit 12 alone can be configured to deliver about 25-30 gallons per minute without pressure head or suction depth. The pump unit 12 is well suited for irrigation from streams, ponds and channels where lift is not needed, and wells where the depth is not below about 22 feet. By way of example, the pump unit 12 may be configured, e.g., to lift in a range of about 5-22 ft of water and create enough pressure for a spray nozzle (about 15 psi) with a 1.5 inch inner diameter hose.

Since it is generally understood to take a reasonably larger force to compress and pull the diaphragm pumps with more then 5 ft of water lift, the frame unit 30 (FIG. 2*b*) was created to provide a mechanical advantage to increase a person's force on the diaphragm pumps 14, 16. Consistent with that shown in FIGS. 2*a*, 2*b* and 2*c*, the pump unit 12 may be configured to slide into and be received by the frame unit 30. Elongated assembly frame members or arms 32*a*, 32*b* may be lowered on the pump's pedals 18*a*, 18*b* as best shown in FIG. 2*c*. The elongated assembly frame members or arms 32*a*, 32*b* may be configured with extended foot pedals 34*a*, 34*b*. A person can stand on the extended foot pedals 34*a*, 34*b* of the elongated assembly frame members or arms 32*a*, 32*b* and then step up and down and shifting one's weight from one leg to the next.

According to embodiments shown in relation to FIG. 3, the pump system 100 may include two modular units: a pump unit 112 driven with two large diaphragm pumps 114, 116; and an assembly frame or unit generally indicated as 130 that the pump unit 112 fits into providing a similar mechanical advantage. The assembly frame or unit 130 may be configured with elongated assembly frame members or arms 132*a*, 132*b* and may include foot pedals 118*a*, 118*b* on which a user can stand. The assembly frame or unit 130 may also be configured with a rocker or rocker arm 150 (FIG. 3) connected to both the elongated assembly frame members or arms 132*a*, 132*b*, as well as a center structure 152, that provides the capability to push down one pedal 118*a* or 118*b*, and pull up on the other pedal 118*a* or 118*b* with one foot.

In operation, the complete unit or pumping system 10 may be configured to lift over about 15 ft of water (1.5 inch diameter hose) and create 15 psi of pressure head to power a spray nozzle.

Another key feature to the pump system, e.g., as shown in FIG. 3, is its ability to be transported easily from a storage area to the water source. For example, a wheel 102 has been designed into the pump system 100, so a person can tilt the pump system 100 with a handle 104 and push it along the ground using the wheel 102. The pump system 100 also can be fully repaired without the use of any tools.

The pump systems 10 (FIG. 2) and 100 (FIG. 3) will now be described in further detail below.

FIG. 2: The Pump System 10

In FIG. 2*a*, the pump unit 12 includes a first pump 14 and a second pump 16 arranged in relation to an assembly frame that may be understood to include one or more of elements 19, 22 and/or 31 consistent with that described below. The first pump 14 includes a first pump actuating portion 14*a* that may take the form of, or form part of, a first piston portion of, e.g., a first diaphragm pump. Similarly, the second pump 16 includes a second pump actuating portion 16*b* that may take the form of, or form part of, a second piston portion of, e.g., a second diaphragm pump. The first and second pumps 14, 16 are configured with input ports 14*b*, 16*b* for receiving the fluid to be pumped, and with output ports (not shown) for providing the fluid to be pumped. Diaphragm pumps are known in the art, and the scope of the invention is not intended to be limited to any particular type or kind thereof either now known or later developed in the future. While the present invention is described by way of example in relation diaphragm pumps; embodiments are envisioned using other types or kinds of pumps either now known or later developed in the future, including other types or kind of positive displacement pumps.

The assembly frame of the pump unit 12 includes a rocker arrangement, assembly or device generally indicated as 19, e.g., as shown in FIG. 2*a*, having the center assembly frame member 22, and also may include a base portion 31 configured to receive the first pump 14 and the second pump 16. For example, in FIG. 2*a* the first pump 14 and the second pump 16 are attached to the base portion 31, e.g., using nuts and bolts, and also attached to the center assembly frame member 22, e.g., also using nuts and bolts.

The rocker arrangement, assembly or device 19 also includes the at least one rocker that may take the form of one or more bars 20*a*, 20*b*, 20*c*, 20*d* (FIG. 2*c*) configured to pivotally couple the first pedal 18*a* to the second pedal 18*b*, so that a pushing movement of the first pedal 18*a* in one direction causes a pulling movement of the second pedal 18*b* in an opposite direction, and so that a corresponding pushing movement of the second pedal 18*b* in the one direction causes a corresponding pulling movement of the first pedal 18*a* in the opposite direction.

In operation, the first pedal 18*a* is configured to respond to a pushing force, move the first piston portion 14*a* for pumping the fluid from the first pump 14, and correspondingly move the second piston portion 16*a* for drawing the fluid to be pumped into the second pump 16; and the second pedal 18*b* is configured to respond to a corresponding pushing force, move the second piston portion 16*a* for pumping the fluid from the second pump 16, and correspondingly move the first piston portion 14*a* for drawing the fluid to be pumped into the first pump 14.

In FIGS. 2*a* and 2*c*, the center assembly frame member 22 is arranged between the first pump 14 and the second pump 16. The one or more bars 20*a*, 20*b*, 20*c*, 20*d* are attached pivotally to the center assembly frame member 22 and coupled to the first piston portion 14*a* and the second piston portion 16*a*, for pivotally coupling the first pedal 18*a* to the second pedal 18*b*, as shown.

In particular, the upper rocker 20*a* is attached pivotally to one end portion of the center assembly frame member 22, e.g., using a bolt or screw 22*a*, and coupled to respective upper portions of the first piston portion 14*a* and the second piston portion 16*a*, e.g., using a bolt or screw 22*b*, 22*c*. Similarly, the other upper rocker 20*b* in FIG. 2*a* is also attached pivotally to the other end portion of the center assembly frame member 22 and coupled to respective upper portions the first piston portion 14*a* and the second piston portion 16*a*. (The three couplings related to the other upper rocker 20*b* are not shown in FIG. 2*a*, but are similar to the three couplings associated with the upper rocker 20*a*.) In FIG. 2*a*, the center assembly frame member 22 includes an internal wall portion; and the lower rocker 20*c* is configured to attach pivotally thereto, as shown.

The lower rocker 20*c* is attached pivotally to one end portion of the center assembly frame member 22, e.g., using a bolt or screw 22*d*, and coupled to respective lower portions of the first piston portion 14*a* and the second piston portion 16*a*, e.g., using a bolt or screw 22*e*, 22*f*. Similarly, the other lower rocker 20*d* (FIG. 2*c*) is also attached pivotally to the other end portion of the center assembly frame member 22 and coupled to respective lower portions the first piston portion 14*a* and the second piston portion 16*a*. (The three couplings related to the other upper rocker 20*d* are not shown in FIG. 2*a* or 2*c*, but are similar to the three couplings associated with the lower rocker 20*c*.)

In FIGS. 2*a* and 2*c*, the first pedal 18*a* is coupled directly to the first piston portion 14*a*, and the second pedal 18*b* is coupled directly to the second piston portion 16*a*. The coupling may include, or take the form of, bolting the pedals 18*a*, 18*b* to the piston portion 14*a*, 14*b*, although the scope of the invention is not intended to be limited to the manner or technique used for such a direct coupling.

In FIG. 2*b*, the frame unit 30 includes the first elongated assembly frame member 32*a* having one end portion 32*a*' configured with the first extended pedal 34*a*, and having another end 32*a*" configured to couple pivotally via a pivot 33 (e.g., a bolt) to one part or member 31*a* of the frame unit 30; and a second elongated assembly frame member 32*b* having one corresponding end portion configured with a second extended pedal 34*b*, and having another corresponding end configured to couple pivotally to another part 31*b* of the assembly frame.

The first elongated assembly frame member 32*a* may also include an intermediate portion 32*a*''' configured with a first wheel rotationally 35*a* coupled thereto for rolling on the first pedal 18*a* (see FIGS. 2*a* and 2*c*); and the second elongated assembly frame member 32*b* may include a corresponding intermediate portion 32*b*''' configured with a second wheel 35*b* rotationally coupled thereto for rolling on the second pedal 18*b* (see FIGS. 2*a* and 2*c*).

In FIG. 2*b*, the frame unit 30 includes other structural members such as a base member 37 and cross member 39 on which the first and second elongated assembly frame members 32*a*, 32*b* may rest.

In FIG. 2*c*, the pump system 10 includes input hosing 41*a*, 41*b* coupled to the input port of the pumps 14, 16 for providing the fluid to be pumped from the water source (not shown) to the pumps 14, 16, and includes output hosing 43*a*, 43*b* and 43*c* coupled to the output ports of the pumps 14, 16 for providing the fluid to be pumped from the pumps 14, 16. As shown, the two output hosing 43*a*, 43*b* is coupled via a coupling 45 into the single hosing 43*c*.

FIG. 3: The Pump System 100

Figure 3A:
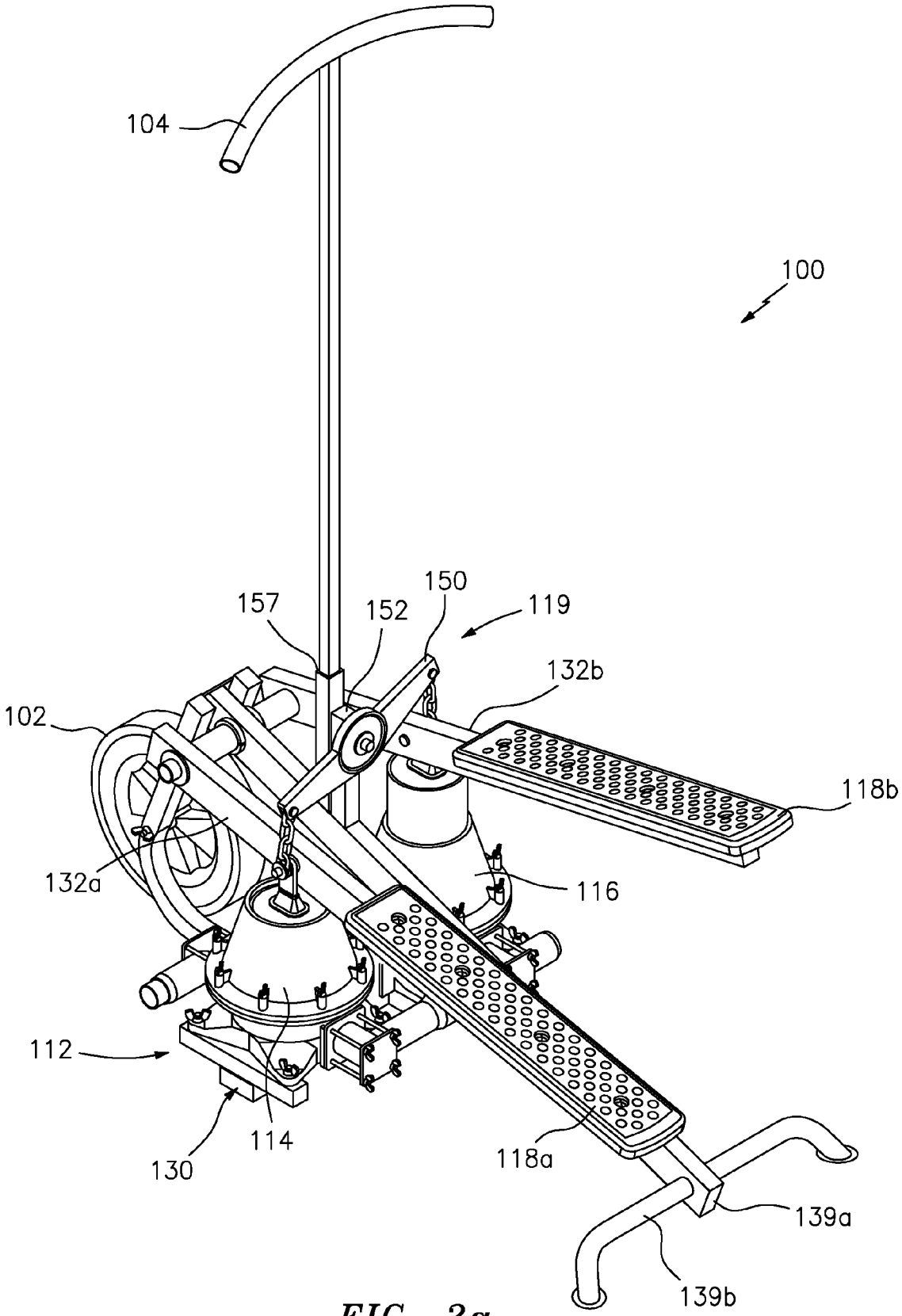
FIG. 3 shows apparatus, including a pump system, according to some embodiments of the present invention, including FIG. 3*a* that is a perspective view of the pump system.
FIG. 3*b* that is a perspective view of the pump system shown in FIG. 3*a* without the handle.
FIG. 3*c* that is a side view of the pump system.
FIG. 3*d* that is a top down view of the pump system.
FIG. 3*e* that is a front view of the pump system.
FIG. 3*f* that is a front view of the pump system having a partial cutaway of an assembly pump.
Figure 3B:
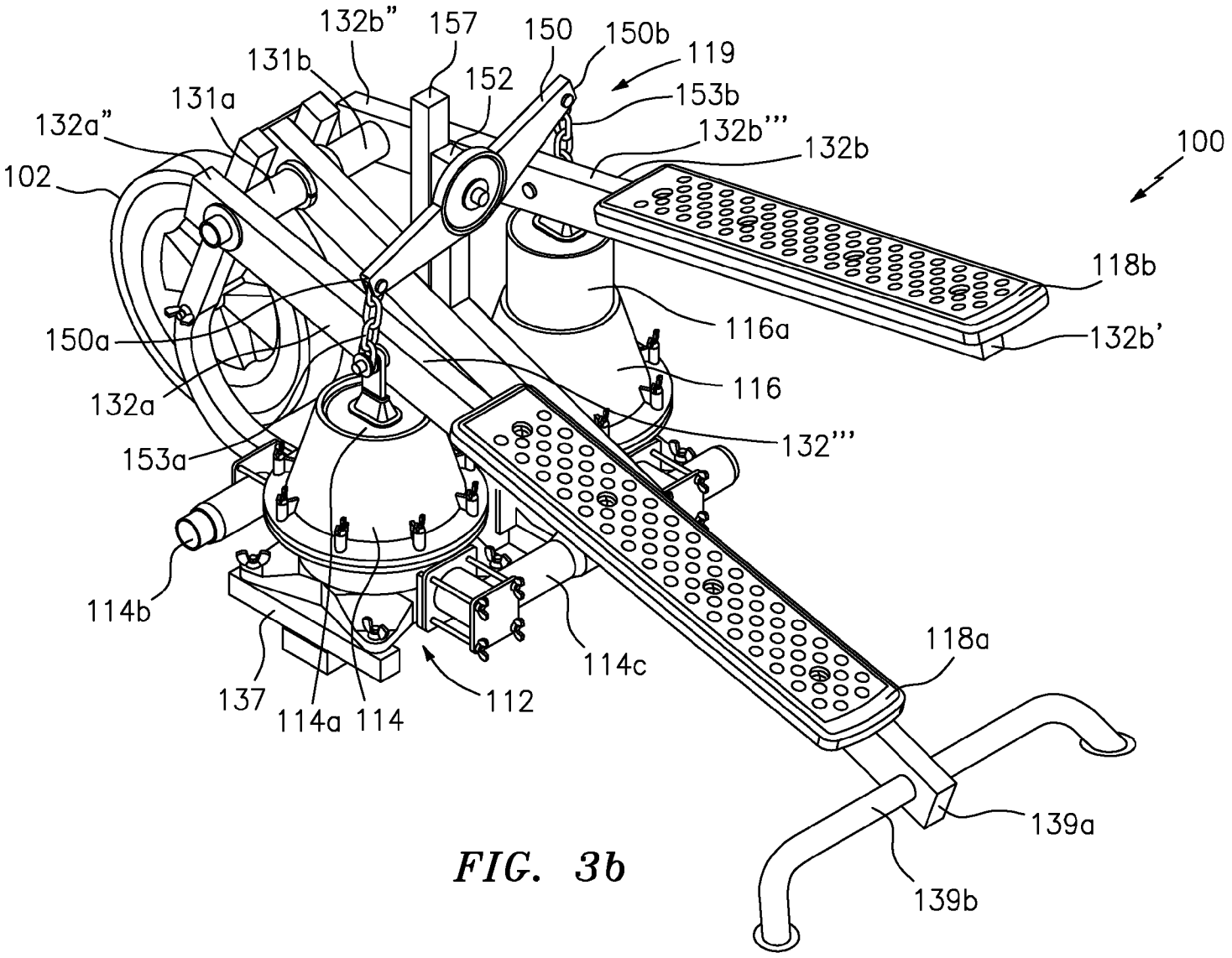

In FIGS. 3*a* and 3*b*, the pump system 100 includes the pump unit 112 having the first pump 114 configured with a first pump actuating portion 114*a*; having the second pump 116 configured with a second pump actuating portion 116*a*; and having an assembly frame or unit 130 configured to receive the first pump 114 and the second pump 116. The first pump actuating portion 114*a* may take the form of, or form part of, a first piston portion of, e.g., a first diaphragm pump; and the second pump actuating portion 116*b* that may take the form of, or form part of, a second piston portion of, e.g., a second diaphragm pump, consistent with that set forth herein. By way of example, the diaphragm assembly for pump 114 is generally indicated as 117 shown in FIG. 3*f* and at least includes a diaphragm portion 117*a* coupled via a coupling means 117*b* to the first piston portion 114*a* and also coupled between upper and lower pump portions 144*b*, 114*c* of the pump 114. The pump 116 is configured with a similar diaphragm assembly (not shown).

The assembly frame or unit 130 includes a first pedal 118*a* coupled to the first piston portion 114*a* and a second pedal 118*b* coupled to the second piston portion 116*a*. The assembly frame or unit 130 a rocker arrangement, assembly or device generally indicated as 119 having at least one rocker 150 configured to pivotally couple the first pedal 118*a* to the second pedal 118*b*, so that a pushing movement of the first pedal 118*a* in one direction causes a pulling movement of the second pedal 118*b* in an opposite direction, and so that a corresponding pushing movement of the second pedal 118*b* in the one direction causes a corresponding pulling movement of the first pedal 118*a* in the opposite direction. The first pedal 118*a* may be configured to respond to a pushing force, move the first piston portion 114*a* for pumping a fluid from the first pump 114, and correspondingly move the second piston portion 116*a* for drawing the fluid to be pumped into the second pump 116. The second pedal 118*b* may be configured to respond to a corresponding pushing force, move the second piston portion 116*a* for pumping the fluid from the second pump 116, and correspondingly move the first piston portion 114*a* for drawing the fluid to be pumped into the first pump 114.

The rocker arrangement, assembly or device 119 includes the center assembly frame member 152 arranged between the first pump 114 and the second pump 116. The rocker 150 is attached pivotally to the center assembly frame member 152 and coupled to the first piston portion 114*a* and the second piston portion 116*a*.

The assembly frame or unit 130 may include a first elongated assembly frame member 132*a* having one end portion 132*a*' configured with a first extended pedal 118*a*, and having another end 132" configured to couple pivotally to one part 131*a* of the assembly frame or unit 130; and a second elongated assembly frame member 132*b* having one corresponding end portion 132*b*' configured with a second extended pedal 118*b*, and having another corresponding end 132*b*" configured to couple pivotally to another part 131*b* of the assembly frame or unit 130.

The first elongated assembly frame member 132*a* may include an intermediate portion 132*a*''' configured to couple to the first piston portion 114*a* and a first end 150*a* of the one rocker 150, and the second elongated assembly frame member 132*b* may include a corresponding intermediate portion 132*b*''' configured to couple to the second piston portion 116*a* and a second end 150*b* of the rocker 150. In this embodiment, the intermediate portion 132*a*''' is configured to couple to the first pedal 118*a* to the first piston portion 114*a*, and the corresponding intermediate portion 132*b*''' is configured to couple to the second pedal 118*b* to the second piston portion 116*a*. As shown the coupling takes the form of a chain arrangement having links 153*a* affixed to the first end 152*a* of the rocker 150 and the first piston portion 114*a*, and having links 153*b* affixed to the second end 152*b* of the rocker 150 and the second piston portion 116*a*, although the scope of the invention is intended to include other types or kinds of couplings either now known or later developed in the future.

The assembly frame or unit 130 may also include the T-shaped handle 104 configured to extend from a part or member 157 of the center assembly frame member 152 and be held by a user when operating the pump system.

The assembly frame or unit 130 may also include the wheel 102 configured on a part or member 159 of the assembly frame 130 for tilting and rolling the pump system 100 in order to deploy it in a desired location, e.g., near a stream, river or pond.

In FIG. 3, the frame unit 130 includes other structural members such as a base member 137, a frame member 139*a* and a cross member 139*b* for supporting the pump system 100.

The pump system 100 includes input and output ports 114*b*, 114*c* for coupling to hosing, consistent with that set forth herein.

Figure 3D:
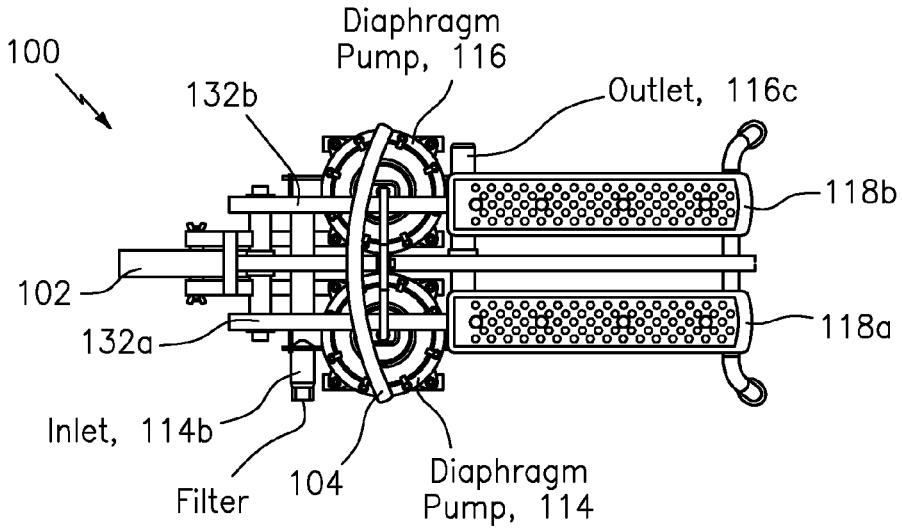
Figure 3C:
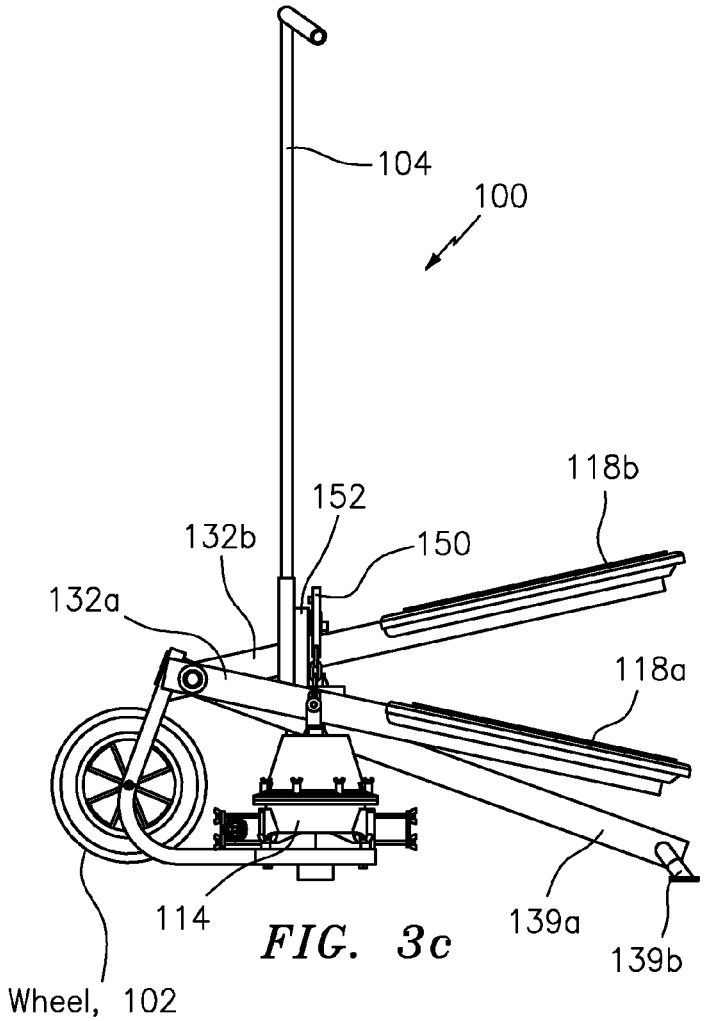
Figure 3E:
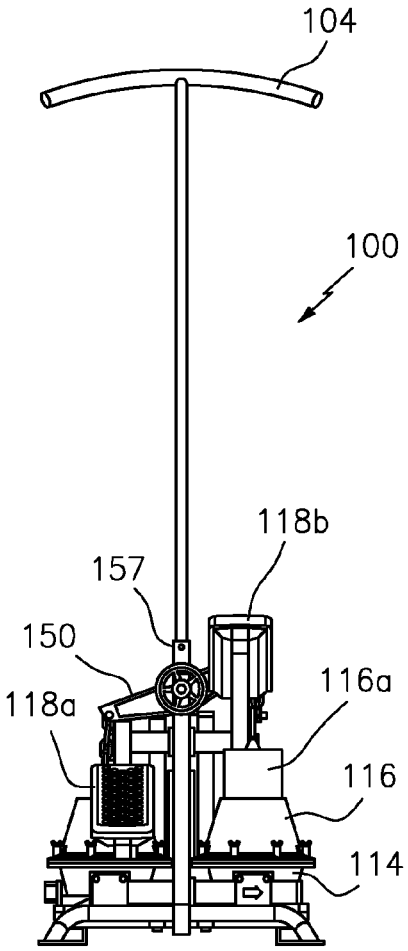
Figure 3F:
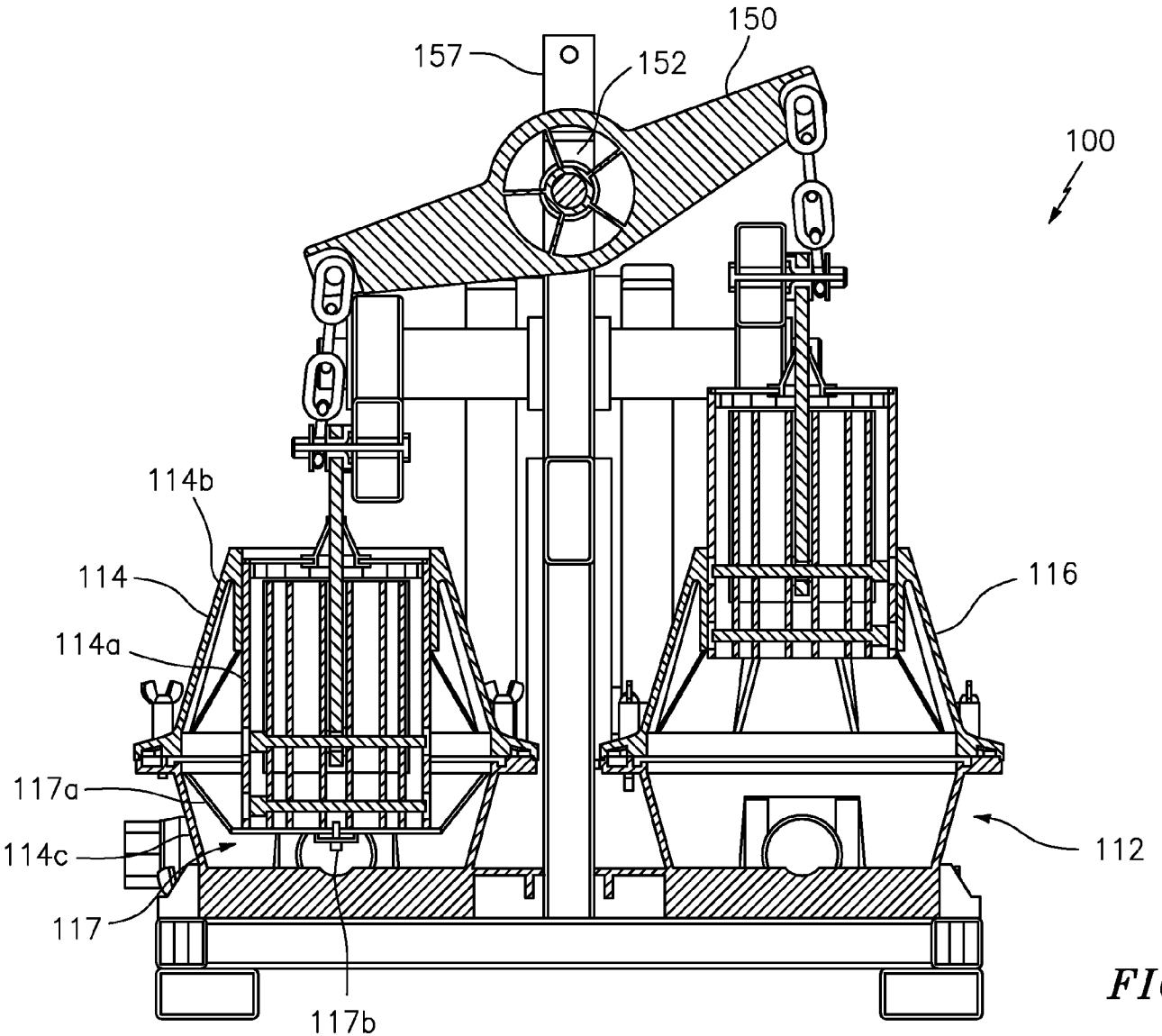

The pump system 100 may also include a filter 115 coupled to the input 114*b*, as shown in FIG. 3*d*.

For the sake of enhancing the overall description of the present invention, and for the sake of reducing clutter in the Figures, each element is not necessarily numbered or labeled in each Figure.

The Scope of the Invention

Further still, the embodiments shown and described in detail herein are provided by way of example only; and the scope of the invention is not intended to be limited to the particular configurations, dimensionalities, and/or design details of these parts or elements included herein. In other words, a person skilled in the art would appreciate that design changes to these embodiments may be made and such that the resulting embodiments would be different than the embodiments disclosed herein, but would still be within the overall spirit of the present invention.

It should be understood that, unless stated otherwise herein, any of the features, characteristics, alternatives or modifications described regarding a particular embodiment herein may also be applied, used, or incorporated with any other embodiment described herein. Also, the drawings herein are not necessarily drawn to scale.

Although the invention has been described and illustrated with respect to exemplary embodiments thereof, the foregoing and various other additions and omissions may be made therein and thereto without departing from the spirit and scope of the present invention.

What we claim is:

1. Apparatus, including a pump system, comprising:

a first pump configured with a first pump actuating portion;

a second pump configured with a second pump actuating portion;

an assembly frame configured to receive the first pump and the second pump, having a first pedal coupled to the first pump actuating portion, a second pedal coupled to the second pump actuating portion, and also having a rocker arrangement with at least one rocker configured to pivotally couple the first pedal to the second pedal, so that a pushing movement of the first pedal in one direction causes a pulling movement of the second pedal in an opposite direction, and so that a corresponding pushing movement of the second pedal in the one direction causes a corresponding pulling movement of the first pedal in the opposite direction;

the first pedal configured to respond to a pushing force, move the first pump actuating portion for pumping a fluid from the first pump, and also correspondingly move the second pump actuating portion for drawing the fluid to be pumped into the second pump;

the second pedal configured to respond to a corresponding pushing force, move the second pump actuating portion for pumping the fluid from the second pump, and also correspondingly move the first pump actuating portion for drawing the fluid to be pumped into the first pump;

a frame unit having a first elongated assembly frame member having one end portion configured with a first extended pedal, and having another end configured to couple pivotally to one part of the assembly frame, and the first elongated assembly frame member having an intermediate portion configured with a first wheel rotationally coupled thereto for rolling on the first pedal; and a second elongated assembly frame member having one corresponding end portion configured with a second extended pedal, and having another corresponding end configured to couple pivotally to another part of the assembly frame, the second elongated assembly frame member having a corresponding intermediate portion configured with a second wheel rotationally coupled thereto for rolling on the second pedal.

2. Apparatus according to claim 1, wherein the rocker arrangement comprises:

a center assembly frame member arranged between the first pump and the second pump; and the at least one rocker being configured to attach pivotally to the center assembly frame member and couple to the first pump actuating portion and the second pump actuating portion.

3. Apparatus according to claim 2, wherein the at least one rocker comprises:

a first rocker configured to attach pivotally to one end of the center assembly frame member and couple to the first pump actuating portion and the second pump actuating portion; and a second rocker configured to attach pivotally to another end of the center assembly frame member and also couple to the first pump actuating portion and the second pump actuating portion.

4. Apparatus according to claim 2, wherein the at least one rocker comprises:

an upper rocker configured to attach pivotally to an upper portion of the center assembly frame member and couple to the first pump actuating portion and the second pump actuating portion; and a lower rocker configured to attach pivotally to a lower portion of the center assembly frame member and also couple to the first pump actuating portion and the second pump actuating portion.

5. Apparatus according to claim 4, wherein the center assembly frame member includes an internal wall portion; and the lower rocker is configured to attach pivotally to the internal wall portion.

6. Apparatus according to claim 1, wherein the first pump and the second pump are diaphragm pumps.

7. Apparatus according to claim 6, wherein the first pump actuating portion includes a first piston portion that is coupled to a first diaphragm portion of the first diaphragm pump, and the second pump actuating portion includes a second piston portion that is coupled to a second diaphragm portion of the second diaphragm pump.

8. Apparatus according to claim 1, wherein the first pedal is coupled directly to the first pump actuating portion, and the second pedal is also coupled directly to the second pump actuating portion.

9. Apparatus according to claim 2, wherein the assembly frame further comprises a T-shaped handle configured to extend from the center assembly frame member and be held by a user when operating the pump system.

* * * * *